US005166005A

United States Patent [19]

Goka et al.

[11] Patent Number: 5,166,005

[45] Date of Patent: Nov. 24, 1992

[54] PATTERN FOR CASTINGS AND THE CASTINGS PRODUCED THEREFROM

[75] Inventors: Masahito Goka; Tadaomi Hirotsu, both of Fukuoka, Japan

[73] Assignee: Hitachi Metals, Ltd., Tokyo, Japan

[21] Appl. No.: 735,960

[22] Filed: Jul. 25, 1991

Related U.S. Application Data

[63] Continuation of Ser. No. 531,157, May 31, 1990, U.S. Pat. No. 5,070,929.

[30] Foreign Application Priority Data

Jun. 6, 1989 [JP] Japan ..... 1-66071

[51] Int. Cl.[5] ..... B22C 7/00

[52] U.S. Cl. ..... 428/577; 428/599

[58] Field of Search ..... 164/235, 241, 242, 243, 164/45, 44; 428/577, 582, 587, 599, 600

[56] References Cited

U.S. PATENT DOCUMENTS 2,424,779 7/1947 Townsend ..... 428/599
4,719,958 1/1988 Schopp et al. ..... 164/29

FOREIGN PATENT DOCUMENTS

3316120A1 11/1984 Fed. Rep. of Germany .
53-50728 12/1978 Japan .
57-156861 9/1982 Japan .

*Primary Examiner*—John Zimmerman
*Attorney, Agent, or Firm*—Finnegan, Henderson, Farabow, Garrett and Dunner

[57] ABSTRACT

The present invention relates to a pattern for castings and the castings produced from the pattern. The pattern comprises a pattern plate including a parting plane, at least one multistage draft and at least one substantial draft extending from the parting plane. A casting having a suitable draft includes corner portions formed by the parting plane.

8 Claims, 3 Drawing Sheets

PATTERN FOR CASTINGS AND THE CASTINGS PRODUCED THEREFROM

This is a continuation of application Ser. No. 07/531,157, filed May 31, 1990, now U.S. Pat. No. 5,070,929.

BACKGROUND OF THE INVENTION

1. Field of the Invention

The present invention relates to a pattern for castings and castings produced by the pattern of the invention, and more particularly to a pattern which is provided with a suitable multistage draft that improves clamping or mold compaction performance and pattern drawing performance at corner portions of the parting plane to reduce the chance of mold drop.

2. Description of the Prior Art

FIG. 5 shows a conventional pattern for castings. The pattern is provided with a single draft having an angle 8' of generally 1–3 degrees for a smooth pattern draw. A corner portion 9' at a parting plane of the pattern 1' is also provided with a chamfer R of a suitable size (conventionally 1–3 mm) to avoid improper mold clamping as well as mold drop when removing the pattern. Mold drop occurs when transmitted to the corner portion 9' at the parting plane 5' when molding.

The provision of the chamfer R considerably improves the mold clamping performance at the corner portion 9' but causes sharp and peaked acute casting fins 6 at the tip end of the casting as shown in FIG. 7. There is a possibility of workers hurting their hands on the acute casting fins 6. Also, the casting fins 6 may be caught by transferring devices as well as jigs and tools in subsequent machining and assembly operations causing various troubles. In order to avoid these problems the casting fins must first be removed before the subsequent processes can take place, which requires a considerable amount of time. Furthermore, chamfers R are absolutely unnecessary from the point of view of the physical dimensions of the final product.

As shown in FIG. 6, some patterns are made with edges having a substantially right angle at the corner portion 9' rather than the chamfer R. However, in these cases the clamping performance is by no means adequate at these corner portions, thereby causing mold drop when drawing the pattern, as well as causing casting fins which must be removed as described above.

As illustrated in FIG. 4, Japanese Utility Model Publication No. 53-50728 discloses a pattern for pipe joints or valves which is provided with a draft in the form of tangent lines 10 intercepting the parting plane 5, drawn from the outer surface of a circular body of the pipe. By this arrangement, the draft in the vicinity of the parting plane 5 is not strictly vertical, which not only avoids the mold drop at the corner portion 9 but also ensures improved mold clamping performance at the corner portion 9. This arrangement may be applied to the castings such as the pipe joints and valves in which the height of the casting is not large, but may not be applied to conventional castings that are vertical (at right angle to the parting plane) and relatively tall in height.

SUMMARY OF THE INVENTION

An object of the present invention is to provide a casting pattern in which proper setting of the shapes, dimensions, and draft of the pattern provides less possibility of causing acute casting fins, as well as improving the strength of the corner portions for conventional vertical and relatively tall castings.

Another object of the invention is characterized by a pattern for castings having a suitable draft which is provided with at least one multistage draft in the vicinity of the corner portions of the parting plane. The term multistage draft refers to a substantial draft and at least one additional stage draft, proceeding toward the parting plane.

To achieve the objects and in accordance with the purpose of this invention, as embodied and broadly described herein the invention comprises a pattern for castings having a suitable draft. The pattern comprises a pattern plate in communication with the pattern. The pattern plate has a parting plane and the pattern includes at least one additional draft extending toward the parting plate and connecting to the substantial draft.

The invention further comprises a casting having a suitable draft. The casting comprises corner portions that are formed by a parting plane of a pattern for making the casting and by at least one multistage draft in the vicinity of the corner portions.

It is to be understood that both the foregoing general description and the following detailed description are exemplary and explanatory only and are not restrictive of the invention, as claimed.

The accompanying drawings, which are incorporated in and constitute a part of this specification, illustrate the embodiments of the invention and together with the description, serve to explain the details, features and advantages of the invention.

DETAILED DESCRIPTION

Reference will now be made in detail to the present preferred embodiments of the invention, examples of which are illustrated in the accompanying drawings. Wherever possible, the same reference number will be used throughout the drawings to refer to the same or like parts.

Figure 1:
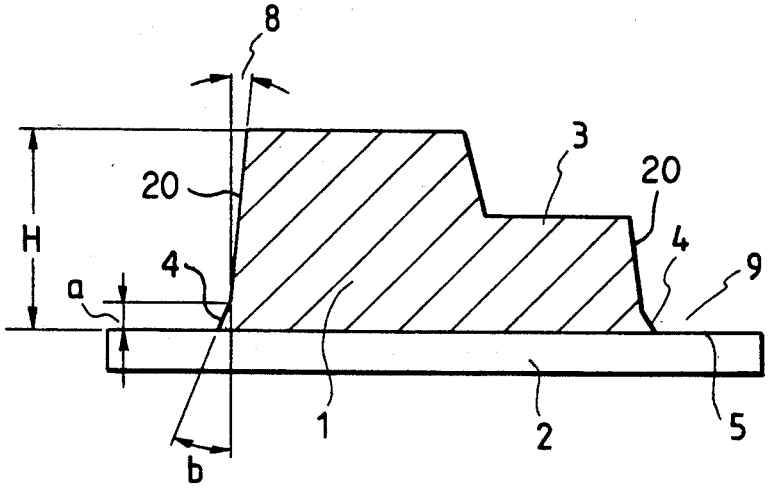
FIG. 1 is a cross-sectional view of a male pattern for castings according to the present invention.

As shown in FIG. 1, a break point of the final stage 4 of the multistage draft starts for example 2–10 mm from the parting plane 5 and pattern plate 2. The height a of the final stage draft 4 is divided by the height H, which is the maximum extent that the substantial draft 20 (having a draft angle 8) rises from the parting plane 5. The ratio a/H represented in percentage, is selected to be from 1–50%, while the angle b of the final stage draft 4 is selected to be between 2–10 degrees. This is because a final stage draft 4 that begins less than 2 mm from the parting plane 5 as well as having a value of a/H less than 1% is not effective in improving the mold clamping performance. Moreover, a break point of the final stage draft 4 that rises more than 10 mm as well as a value a/H of more than 50% causes too large a draft, which in turn causes deviations from the desired casting dimensions. Another reason why the angles b of the final stage draft 4 should be between 2–10 degrees, is that angles less than 2 degrees are not effective in mold clamping while angles larger than 10 degrees cause deviations from the desired dimension.

A second aspect of the invention is characterized by castings produced through the use of the above pattern. The castings have a suitable draft and are provided with at least one additional stage draft in the vicinity of the corner portion of the parting plane.

Figure 7:
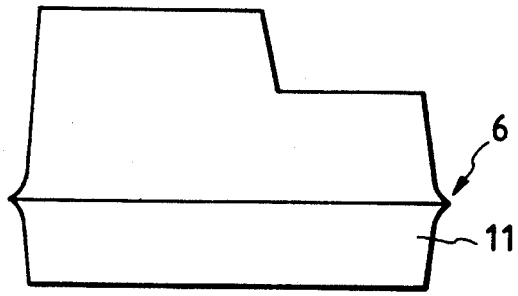
FIG. 7 PRIOR ART
FIG. 7 is a side view illustrating casting fins produced by the castings of the prior art.
Figure 8:
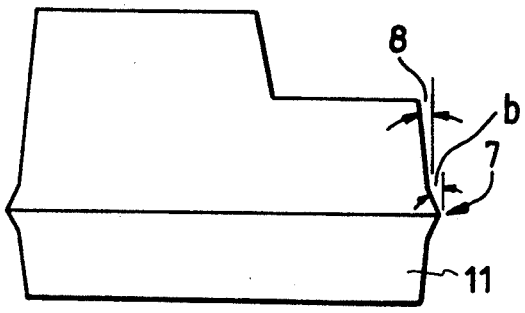
FIG. 8 is a side view of a casting illustrating casting fins according to the present invention.

The present invention is arranged as described above, thus the mold clamping performance at the corner portion is greatly improved without the chamfer R as compared to the conventional pattern, and is equal to or better than the one with a chamfer radius of 1–3 mm. Another advantage of the present invention is that the casting fins of casting 11 resulting from the practice of the present invention are rather obtuse projections 7 as shown in FIG. 8. This contrasts with the sharp and acute casting fins 6 that result from the conventional chamfer radius of 1–3 mm as shown in FIG. 7. The projections produced by the present invention protrude more than those for castings with no chamfer, but have no casting fins with acute tip ends as do castings having a chamfer. Thus, no substantial fin removing operation is required before completing the castings.

Figure 2:
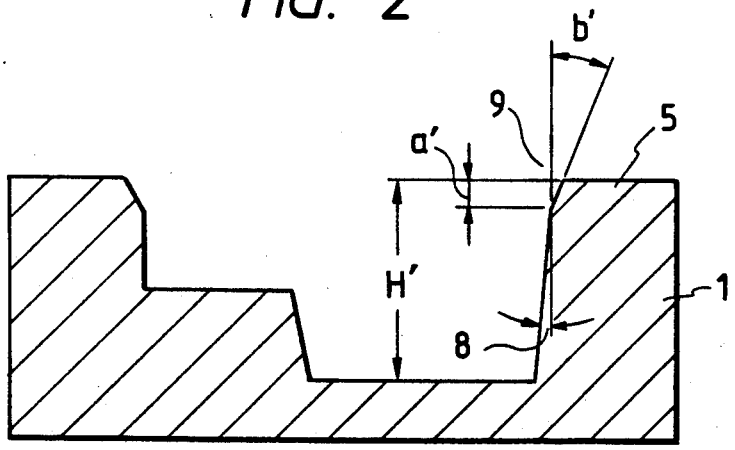
FIG. 2 is a mold made by the male pattern for castings according to the present invention.

As shown in FIG. 2, in the female casting pattern 1 the heights a′ and H′ extend below the parting plane and are selected to have the same range of values as the male casting pattern of FIG. 1. The angle b′ can have the same range of values as the angle b discussed above.

Figure 3:
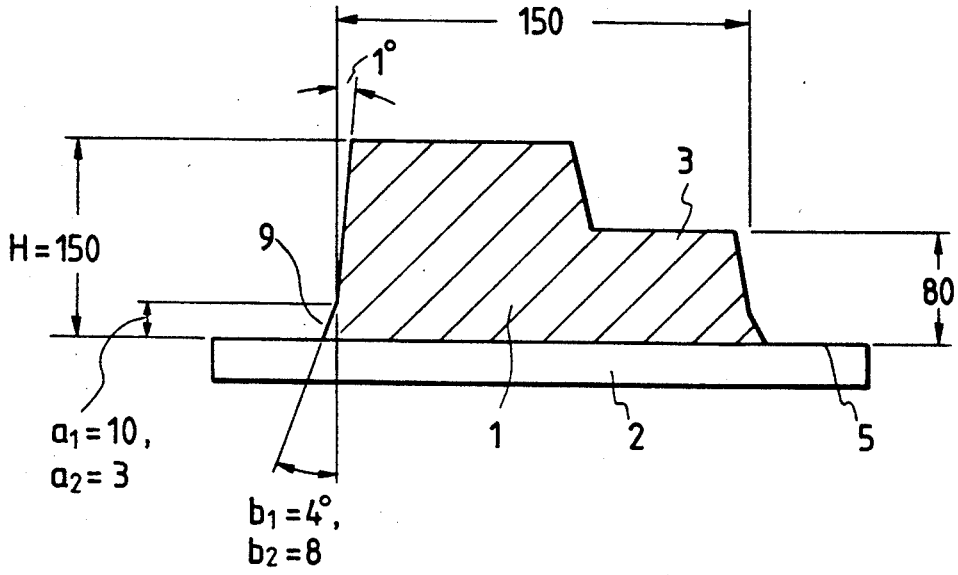
FIG. 3 is an illustration showing dimensions of the pattern for castings used in the embodiments of the invention.
Figure 4:
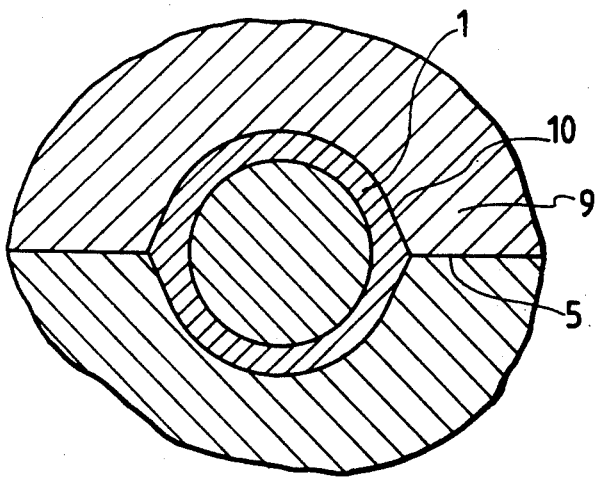
FIG. 4 PRIOR ART
FIG. 4 is a cross-sectional view of the pattern for tube joints and valves to which a tangent draft is applied.

In one embodiment of the invention, a basic pattern 1 has a width of 100 mm, a length of 150 mm, a maximum height H of 150 mm, a height of flat land 3 of 80 mm, and a draft angle 8 of 1 degree as shown in FIG. 3. Then, a pattern #1 was made to have at the corner portion 9 of the parting plane 5 thereof an angle b1 of four degrees at a height a1 of 10 mm from the parting plane 5. Still another pattern #2 was made to have an angle b2 of eight degrees at a height a2 of 3 mm from the parting plane 5, also shown in FIG. 3.

Figure 5:
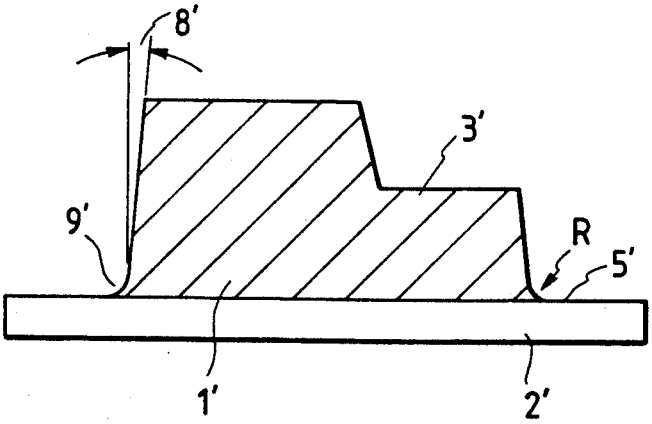
FIG. 5 PRIOR ART
FIG. 5 is a cross-sectional view of a conventional pattern for castings having a chamfer R at the corner portion thereof.
Figure 6:
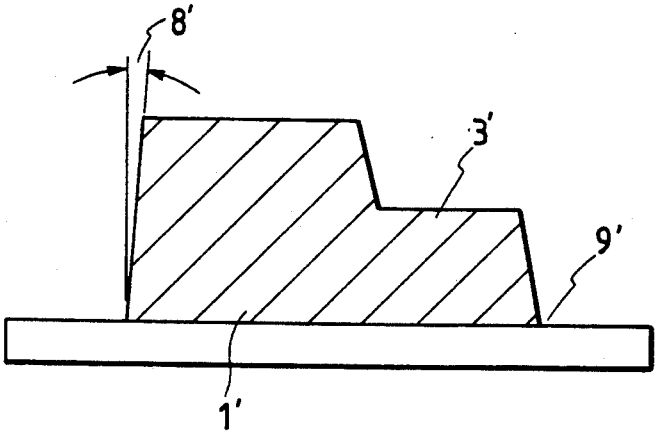
FIG. 6 PRIOR ART
FIG. 6 is a cross-sectional view of a conventional pattern for castings without a chamfer.

Several patterns for comparison purposes were made: a pattern #3 having no chamfer R as shown in FIG. 6, a pattern #4 having a chamfer R of 1 mm as shown in FIG. 5, a pattern #5 having a chamfer R of 2 mm, and a pattern #6 having a chamfer R of 3 mm.

Twenty moldings were made for each of these six patterns using the same casting sand and were poured to evaluate:

(a) the mold drop of the corner portions of the drawing pattern and (b) the average length of casting fins of the castings.

Table 1 shows the results.

TABLE 1

| | a | b | R | mold drop | (mm) length of the casting fin | removal of casting fins |
|---|---|---|---|---|---|---|
| #1 | 10 | 4° | — | 1 | 0.7 | Not required |
| #2 | 3 | 8° | | 2 | 0.5 | Not required |
| #3 | — | — | 0 | 12 | 1.5 | required |
| #4 | — | — | 1 | 6 | 1.3 | required |

TABLE 1-continued

| | a | b | R | mold drop | (mm) length of the casting fin | removal of casting fins |
|---|---|---|---|---|---|---|
| #5 | — | — | 2 | 2 | 1.9 | required |
| #6 | — | — | 3 | 1 | 2.5 | required |

The entire circumference of each of the castings was measured and the measurements averaged out for the twenty castings, including those that resulted in mold drop.

As is apparent from the above description, the use of the pattern for castings according to the present invention makes it possible to ensure mold clamping performance at the corner portions thereof, the mold clamping performance being as good as or even better than those of chamfered corner portions.

Also, the castings through the use of the pattern of the present invention have no acute casting fins at their tip ends such as the acute casting fins formed by the conventional castings, but have gradually varying contours, eliminating the need of removing casting fins. Thus, the present invention makes it possible to improve the efficiency in molding and to greatly reduce the subsequent removing processes which would otherwise be required.

What is claimed is:

1. A casting having a suitable draft comprising:

corner portions of the casting in the vicinity of a plane defined by a parting plane of a pattern for making said casting; and at least one multistage draft in the vicinity of said corner portions, said multistage draft including a substantial draft forming a single draft angle c, a final stage forming a single draft angle b, angles b and c being with respect to a line perpendicular to said plane, angle c being less than angle b.

2. The casting of claim 1, wherein said final stage has a height a from said plane, and wherein said height a is between 2 and 10 mm.

3. The casting of claim 2, wherein said multistage draft includes a substantial draft having a maximum extent of H from said plane, and wherein a and H are related so that said height a of said final stage is between 1% and 50% of H.

4. The casting of claim 1, wherein said angle b of said final stage is between 2 and 10 degrees.

5. A casting produced by a mold having a parting plane, the casting comprising:

a planar portion corresponding to the parting plane;

a first draft adjacent the planar portion, the first draft rising in a direction perpendicular to the planar portion, the first draft rising a first substantial height at a single first angle with respect to a line normal to the planar portion; and a second draft adjacent the first draft, the second draft rising a second substantial height in a direction perpendicular to the planar portion, the second draft rising at a single second angle with respect to a line normal to the planar portion, the second angle being less than the first angle.

6. The casting as claimed in claim 5, wherein the first substantial height rises 2 to 10 millimeters.

7. The casting as claimed in claim 5, wherein the first substantial height rises a first height $h_1$ above the planar portion and the second substantial height rises to a maximum of $h_2$ above the first draft, and wherein $$0.01 < h_1/(h_1+h_2) < 0.5$$

8. The casting as claimed in claim 5, wherein the first angle is 2 to 10 degrees.

* * * * *